US010332492B2

(12) United States Patent
Kanakis

(10) Patent No.: US 10,332,492 B2
(45) Date of Patent: Jun. 25, 2019

(54) ELECTRIC GUITAR / BASS WITH DOUBLE NECK, WHICH IS DIVIDED INTO TWO SEPARATE AUTONOMOUS GUITARS / BASSES

(71) Applicant: Christoforos Kanakis, Attiki (GR)

(72) Inventor: Christoforos Kanakis, Attiki (GR)

( * ) Notice: Subject to any disclaimer, the term of this patent is extended or adjusted under 35 U.S.C. 154(b) by 18 days.

(21) Appl. No.: 15/509,861

(22) PCT Filed: Sep. 9, 2015

(86) PCT No.: PCT/GR2015/000044
§ 371 (c)(1),
(2) Date: Mar. 9, 2017

(87) PCT Pub. No.: WO2016/042344
PCT Pub. Date: Mar. 24, 2016

(65) Prior Publication Data

US 2017/0309258 A1 Oct. 26, 2017

(30) Foreign Application Priority Data

Sep. 17, 2014 (GR) ..... 20140100467

(51) Int. Cl.
*G10D 1/08* (2006.01)
*G10D 3/06* (2006.01)

(52) U.S. Cl.
CPC ..... *G10D 1/085* (2013.01); *G10D 1/08* (2013.01); *G10D 3/06* (2013.01)

(58) Field of Classification Search
CPC ..... G10D 1/085; G10D 3/06
USPC ..... 84/267
See application file for complete search history.

(56) References Cited

U.S. PATENT DOCUMENTS 832,157 A * 10/1906 Platts ..... G10D 1/08 84/263
3,130,625 A * 4/1964 Savona ..... G10D 1/08 84/267
4,240,319 A * 12/1980 Soupios ..... G10D 1/085 84/263
D279,195 S * 6/1985 Perkins ..... D17/15
4,785,705 A * 11/1988 Patterson ..... G10D 1/085 84/263
4,953,434 A * 9/1990 Guss ..... G10D 1/00 84/173
4,987,815 A * 1/1991 Shockley ..... G10D 1/08 84/263
5,131,307 A * 7/1992 Castillo ..... G10D 1/085 84/267
5,212,329 A * 5/1993 Woodworth ..... G10D 1/085 84/263
5,315,910 A * 5/1994 Soupios ..... G10D 1/085 84/263

(Continued)

*Primary Examiner* — David S Warren
*Assistant Examiner* — Christina M Schreiber
(74) *Attorney, Agent, or Firm* — Maschoff Brennan

(57) ABSTRACT

A double necked electric guitar/bass that can be divided into two separate autonomous guitars/basses. The division is possible due to the special guitar/bass body composed of two individual bodies, mate and held together by screws or clips. Such an invention provides multiple "3 in 1" uses: a) Double Neck Guitar/Bass, b) A separate instrument only with the first neck, and c) A separate instrument only with the second neck.

4 Claims, 2 Drawing Sheets

(56) References Cited

U.S. PATENT DOCUMENTS

| | | | | | |
|---|---|---|---|---|---|
| 5,571,980 | A * | 11/1996 | Busley | G10D 15/00 | 84/263 |
| 5,918,294 | A * | 6/1999 | Karg | G10D 15/00 | 84/170 |
| 5,994,633 | A * | 11/1999 | Norton | G10D 1/085 | 84/290 |
| 7,211,719 | B2 * | 5/2007 | Blake | G10D 1/085 | 84/267 |
| 8,987,568 | B1 * | 3/2015 | Fucci | G10D 15/00 | 84/263 |
| 9,721,542 | B2 * | 8/2017 | Sperr | G10D 1/085 | |
| 2003/0159562 | A1 * | 8/2003 | Bailey | G10D 1/00 | 84/293 |
| 2003/0188622 | A1 * | 10/2003 | Wilson | G10D 1/00 | 84/267 |
| 2005/0126364 | A1 * | 6/2005 | Ludwig | G10D 1/00 | 84/293 |
| 2017/0148423 | A1 * | 5/2017 | Muse | G10D 3/06 | |
| 2017/0309258 | A1 * | 10/2017 | Kanakis | G10D 3/06 | |
| 2018/0075824 | A1 * | 3/2018 | Gorsuch | G10D 1/08 | |

* cited by examiner

GUITARS/BASSES SEPARATED

Fretless Bass | Fretted Bass | 12-string Guitar | 6-string Guitar

Triple neck pairing

Pairing of more than 3 necks

ELECTRIC GUITAR / BASS WITH DOUBLE NECK, WHICH IS DIVIDED INTO TWO SEPARATE AUTONOMOUS GUITARS / BASSES

TECHNICAL FIELD

The present invention is directed to musical instruments.

BACKGROUND OF THE INVENTION

Guitars/basses with 2 necks are already known. The double necks give music performers dual sound capabilities and simultaneously allow them to have a double role during the musical performance. The double neck guitars/basses are mainly intended for live performance. E.g. when a musician while playing a live track does not have the time to leave the twelve-string guitar and catch the six-string, because this would mean to stop playing at all for at least some seconds. On the contrary, when playing an instrument with 2 necks, the change from one neck to another is almost instantaneous, taking imperceptible time. However the instruments with double necks apart from their increased cost, they have also a very limited use, only for specific circumstances of live music. This is why in the majority of the musical activities of most guitarists/bassists standard single neck instruments are used, which musicians always primarily own. Thus, for any guitarist/bassist buying an instrument with double neck is a high extra cost for an instrument probably not often needed.

SUMMARY OF THE INVENTION

The invention refers to: a) an electric guitar with 2 necks (e.g. with a twelve-string and a six-string neck) that can be divided into two separate autonomous guitars (e.g., a twelve-string and a six-string guitar) b) an electric bass with 2 necks (e.g. a fretted and a fretless neck) that can be divided into two autonomous basses (e.g. a fretted and a fretless bass) c) a combination of electric guitar and bass with 2 necks (e.g. a six-string guitar and a fretted bass) that can be divided into two separate autonomous instruments (e.g. one six-string guitar and a fretted bass). In any case, the division of the mentioned musical instruments is made possible thanks to the specially designed construction of their bodies.

The advantage of this invention is the possibility of its multiple uses, since it can itself serve all possible requirements of its users in different circumstances.

The electric guitar/bass with double neck according to the present invention has the characteristic that it can be divided into individual guitars/basses which are used alternatively by the musician without the need to purchase other originally individual instruments. This is actually a "3 in 1" electric guitar/bass. For example the holder of such an electric bass with two necks (fretted-fretless) of the type proposed by the invention, can easily transform it into a single fretted and a single fretless bass, depending on the circumstances and requirements of the music. This conversion is possible thanks to the divided electric guitar/bass body. So whenever the guitar/bass body splits, 2 individual autonomous instruments are created. The two autonomous instruments have of course the possibility to easily reconnect whenever musical circumstances require it, creating again the original double neck instrument.

BRIEF DESCRIPTION OF THE DRAWINGS

FIG. 2 is only one of the possible combinations that could result by choosing each time different guitar or bass necks.

DETAILED DESCRIPTION OF THE INVENTION

Figure 1:
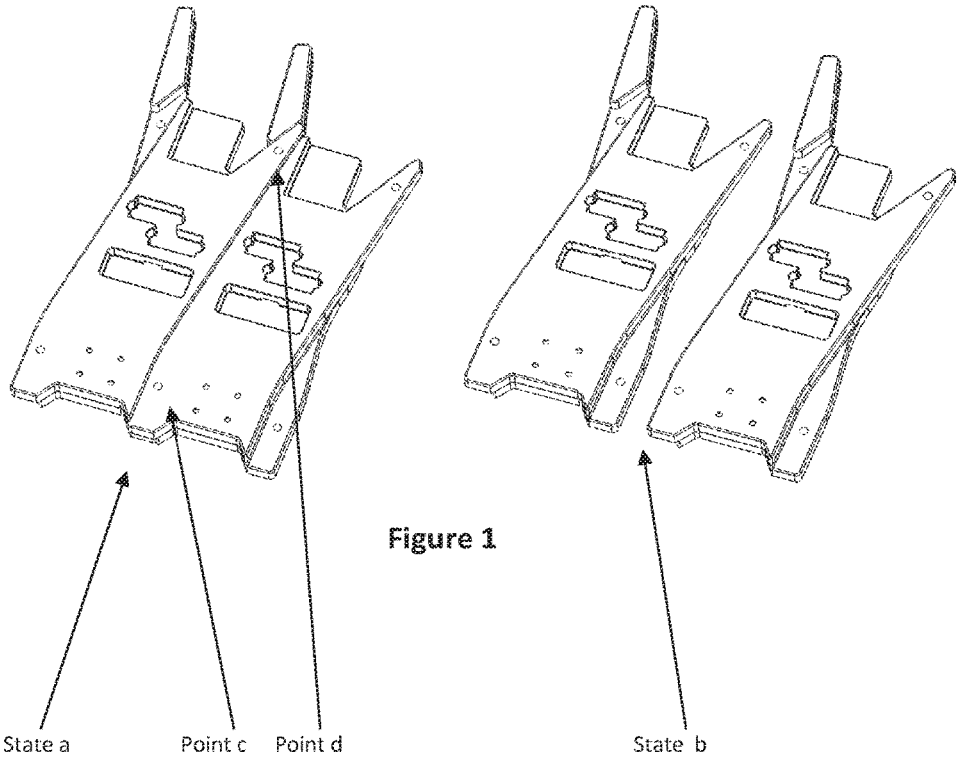
FIG. 1 shows the way the two electric guitar/bass bodies are connected for double neck use (state a) and the manner of their division (state b) from which the two autonomous instruments arise.
Figure 2:
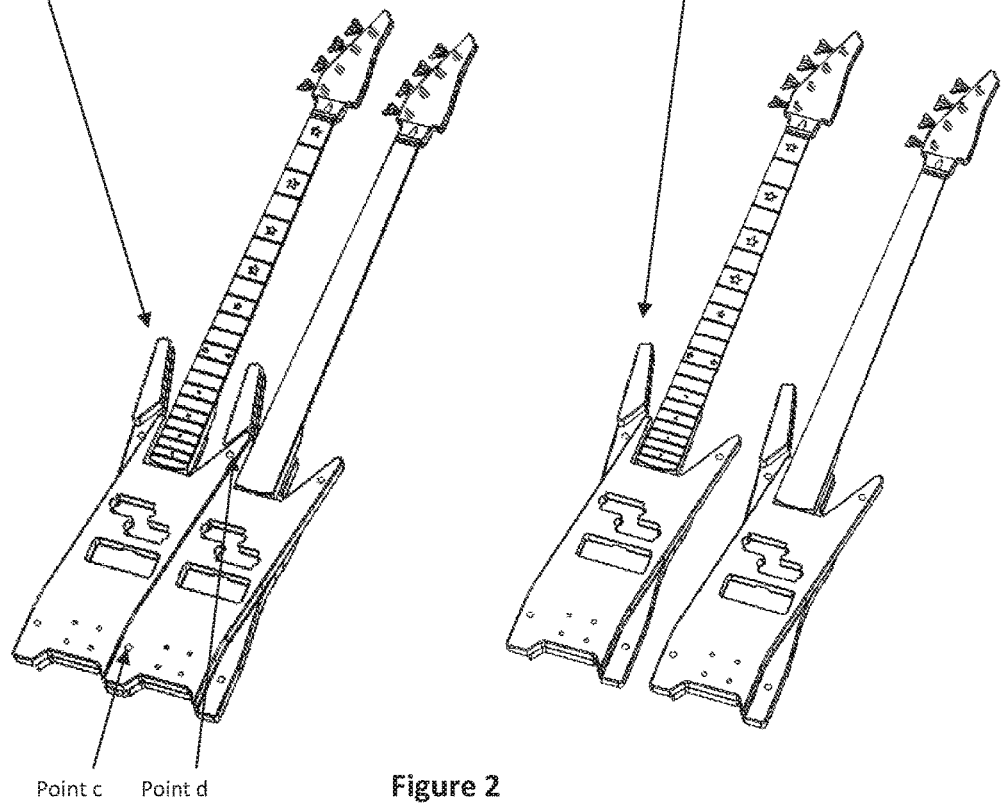
FIG. 2 shows the bodies of FIG. 1 combined with bass necks (fretted-fretless) and the result of their division from which a self-fretted and a self-fretless bass arise.
Figure 3:
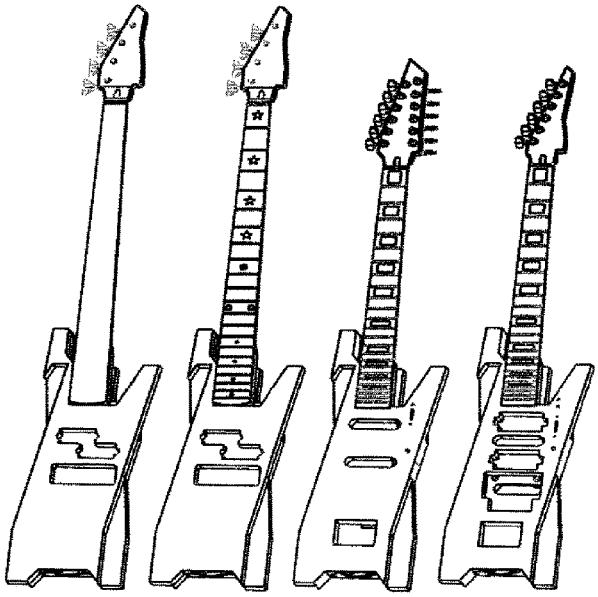
FIG. 3 shows four example autonomous instruments in separation from each other.
Figure 4:
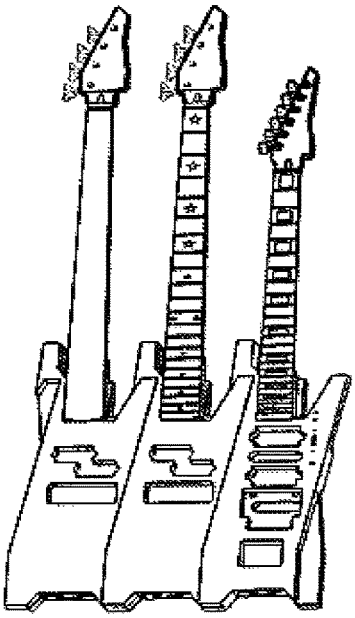
FIG. 4 shows three example autonomous instruments in a connecting combination with each other.
Figure 5:
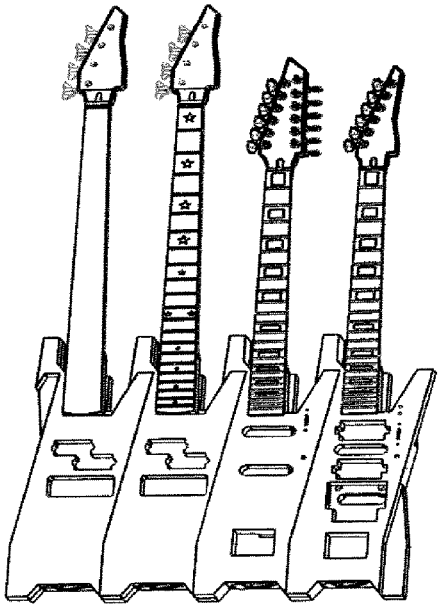
FIG. 5 shows the four example autonomous instruments of FIG. 3 in a connecting combination with each other.

One way of implementing the invention is described with reference to the drawings. The bodies are designed and constructed so as to pair one inside the other when connected (state a) as shown noticeably in the figures, while held together by screws (the screws are not shown in the drawings) that are screwed into the holes (point c) and (point d) as illustrated in FIGS. 1 and 2. In these or other embodiments, multiple bodies and corresponding necks may be combined (e.g., FIGS. 4 and 5) or separated (e.g., FIG. 3) as desired. For example, a triple neck instrument may be formed as shown in FIG. 4, or an instrument with even more necks may be formed as shown in FIG. 5. Additionally or alternatively, separate instruments may be formed like the three separate autonomous instruments shown in FIG. 3.

So whenever the division of the two bodies (state b) is needed, unscrewing the two screws suffices. When using the instrument as a double neck (state a), i.e. the two bodies connected, apart from screws, other types of links (none of them are shown) could be used for inside the holes (point c) and (point d), such as: clips, clip shafts or even a semi locking-unlocking system (each time onto the bodies or removable).

The invention claimed is:

1. An electric guitar/bass with double neck comprising two separate completely autonomous guitars/basses that can be instantly divided or reconnected, without any further transformation or addition, via at least two male portions of a first completely autonomous guitar/bass, the two male portions including: a first male portion at least partially flush with a top surface of the first completely autonomous guitar/bass; and a second male portion positioned below the top surface of the first completely autonomous guitar/bass such that the first male portion and the second male portion are offset from each other relative to the top surface of the first completely autonomous guitar/bass, wherein the first male portion and the second male portion are on a same side of the first completely autonomous guitar/bass, and wherein the first male portion is positioned more proximal to a neck of the first completely autonomous guitar/bass than the second male portion.

2. The electric guitar/bass of claim 1, wherein the two separate completely autonomous guitars/basses can be paired, from both right to left or left to right sides, and are held together as one single body, by screws or clips.

3. The electric guitar/bass, according to claim 2, comprising more than two sub-bodies creating a triple neck instrument, or as an instrument with even more necks at any possible neck order.

4. The electric guitar/bass, according to claim 1, wherein the two separate completely autonomous guitars/basses can be: twelve-string guitar with six-string guitar, fretted bass with fretless bass, and guitar with bass.

* * * * *